US005173980A

United States Patent [19]

Riedel

[11] Patent Number: 5,173,980

[45] Date of Patent: Dec. 29, 1992

[54] METHOD OF CONTINUOUS PERMANENT DECATING AND FIXING OF WEB-SHAPED TEXTILE PRODUCTS, SUCH AS WOVEN TEXTILE, KNITTED TEXTILE, ETC.

[75] Inventor: Dieter Riedel, Porta Westfalica, Fed. Rep. of Germany

[73] Assignee: Johannes Menschner Maschinenfabrik GmbH & Co.KG, Viersen, Fed. Rep. of Germany

[21] Appl. No.: 808,023

[22] Filed: Dec. 13, 1991

[30] Foreign Application Priority Data

Aug. 31, 1991 [DE] Fed. Rep. of Germany ..... 4129030

[51] Int. Cl.[5] ..... D06B 5/08

[52] U.S. Cl. ..... 8/149.1; 8/149.3

[58] Field of Search ..... 8/149.1, 149.3, 151, 8/151.1; 68/5 D, 5 E, 8, 5 B, 5 A, 5 R

[56] References Cited

U.S. PATENT DOCUMENTS

| | | | |
|---|---|---|---|
| 2,451,337 | 10/1948 | Hayes | 68/5 R X |
| 3,943,735 | 3/1976 | Riedel | 68/5 R |
| 4,899,410 | 2/1990 | Riedel | 8/149.3 |
| 5,052,669 | 10/1991 | Riedel | 8/149.1 |

FOREIGN PATENT DOCUMENTS

| | | | |
|---|---|---|---|
| 527472 | 6/1931 | Fed. Rep. of Germany | 68/5 B |
| 553316 | 6/1977 | U.S.S.R. | 68/5 D |
| 2201434 | 9/1988 | United Kingdom | 68/5 D |

*Primary Examiner*—Frankie L. Stinson
*Attorney, Agent, or Firm*—Michael J. Striker

[57] ABSTRACT

A method of continuous permanent decating and fixing of web-shaped textile products includes the steps of moistening a textile product, treating the moistened textile product in a first moist treatment stage by guiding the moistened textile product over a rotatable and heatable cylinder and pressing against a part of a cylinder surface, subsequently moistening the textile product, then treating the textile product in a second dry stage by guiding the textile product over a rotatable and heatable cylinder and pressing it against a part of a cylinder surface so that in the first moist stage one side of the textile product is in contact with the cylinder surface of the first mentioned cylinder while in the second dry stage the other side of the textile product is in contact with the cylinder surface of the second mentioned cylinder, regulating a moisture of the textile product so that shortly before an end of the second dry treatment stage it has a normal moisture, and maintaining pressing actions in the treatment stages so that a ratio of a time of the pressing action of the textile product in the first moist stage to a time of the pressing action in the second dry stage with identical pressures is at least 1.2–2.5.

6 Claims, 2 Drawing Sheets

METHOD OF CONTINUOUS PERMANENT DECATING AND FIXING OF WEB-SHAPED TEXTILE PRODUCTS, SUCH AS WOVEN TEXTILE, KNITTED TEXTILE, ETC.

BACKGROUND OF THE INVENTION

The present invention relates to a method of continuous permanent decating and fixing of web-shaped textile products, such as woven textiles, knitted textiles, etc.

German document DE-PS 3,914,358 discloses a method in accordance with which the moisturized textile product is guided through a rotatably supported, heated cylinder with a closed outer surface. It is pressed against a part of the cylinder surface by an impermeable pressing band which is wound over a deviating roller in a treatment stage I. And then it is guided over a further rotatably supported heatable cylinder with a closed suurface and then pressed against a part of the cylinder surface by an impermeable pressing band wound over a deviating roller in a treatment stage II. In the treatment stage I the textile product lies on the associated cylinder with its left side, and in the treatment II it lies on the associated heatable cylinder with its right side.

This known method has been basically accepted. However, it was determined that in certain cases, namely when the ratio of the time of the treatment stage I and treatment stage II is the same, a relatively low output in the capacity is registered, since the throughgoing speed of the product must be not insignificantly reduced and results in low inefficiency.

SUMMARY OF THE INVENTION

Accordingly, it is an object of the present invention to provide a method of the above mentioned general types which avoids the disadvantages of the prior art.

More particularly, it is an object of the present invention to provide a method of the above mentioned type in which with efficient throughgoing speed of the product, an output increase is achieved with maintaining an optimal decating effect.

In keeping with these objects and with others which will become apparent hereinafter, one feature of the present invention resides, briefly stated, in a method of continuous permanent decating and fixing web-shaped textile products, such as for example woven textiles, knitted textiles, etc., in accordance with which the moisture of the textile product is regulated so that shortly before the end of the treatment stage II it has a normal moisture, and the ratio of the time of the pressing action on the textile product in the treatment stage I to the time of the pressing action in the treatment stage II at the same pressure is at least 1.2–2.5.

It has been found in a surprising manner that in the above mentioned so-called "two-phase decating" the treatment stage I (moist phase) must have a higher time for the pressing action than the treatment stage II (dry phase) with a predetermined continuous throughgoing speed of the product. Furthermore, in a surprising manner it has been determined that the output increase can be achieved only when in addition to the above mentioned condition of the moisture, the product is so controlled shortly before the end of the treatment stage II that the textile assumes the normal moisture. This is achieved in that, in correspondence with the moisture condition of the product, a corresponding post regulation of the moisture is performed automatically.

If for example the moisture of the product after the end of the treatment phase II is above the normal moisture, then the permanence is affected since the effect building is not completed. When to the contrary the product is too dry, then it increases the temperature of the cylinder and as a result a greasy, artificial gloss and feel is produced.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
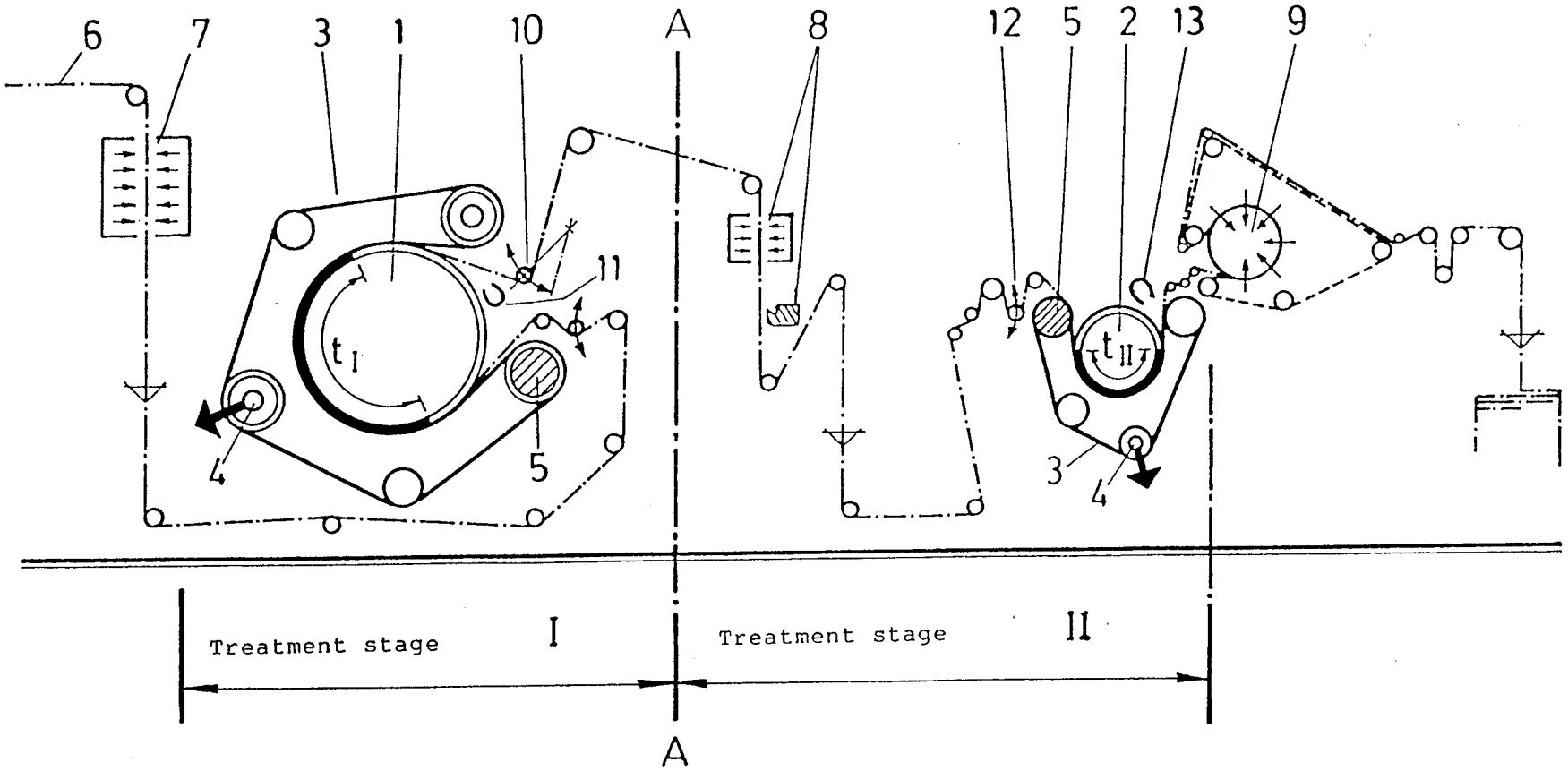
FIG. 1 is a view showing an arrangement for performing treatment stages I and II of a method for a continuous permanent decating and fixing of web-shaped textile products in accordance with the present invention.

Continuous permanent decating and fixing of web-shaped textile products in accordance with the present invention is performed in two stages, namely a treatment stage I and a treatment stage II as shown in FIG. 1. Each stage has a cylinder which is identified with reference numerals 1 and 2 respectively and has a closed outer surface . The outer surfaces can be controllably heated in a suitable manner. A medium-impermeable pressing band is identified with reference numeral 3. It is guided over a part of the associated heatable cylinder 1 and 2 and also over deviating rollers. The deviating rollers include a tensioning roller 4, and also deviating roller 5 which is heatable independently of the cylinder 1 and 2. The heated deviating roller 5 is used for heating the pressing band 3.

The cylinders 1 and 2 have different diameters. The same is true with respect to the forces applied on the pressing bands 3, so that an identical specific surface pressure can be produced on both cylinders 1 and 2. In correspondence with this, the length of the pressing bands 3 are different.

The textile product 6 is guided over the part of the cylinder 1 and 2 which is surrounded by the pressing band 3, so that it lies between the cylinder and the pressing band. Before introducing the textile product 7 in the gap between the pressing band 3 on the one hand and the respective heatable cylinder 1 and 2 on the other hand, the textile product is supplied through a moistening device 7 or 8 respectively. The textile product 6 which leaves the treatment zone 1 is introduced into the next treatment zone II. The heatable cylinder 2 is mirror symmetrical to the heatable cylinder 1, and the plane of symmetry is identified with the reference A—A. As a result the textile product 6 in the treatment stage I lies with its left side and in the treatment stage II lies with its right side on the heatable cylinder 1 and 2. Therefore a uniform product sortie is insured. Moreover, due to this guidance of the textile product 6, there is a possibility that in the case of especially sensitive, unicolor product sorts the left product side can lie against the heatable cylinder 2 of the treatment stage 2 so as to avoid greasy gloss.

In the region of the treatment stage I (moist phase) where the textile product 6 lies with its right side against the cylinder 1, the greasy gloss is not registered due to the high moisture content. The evaporation occurs when the textile product 6 leaves the cylinder 1.

A fine compensating device 10 senses the product 6 without loading and serves for automatic post-regulation of the product transportation performed by a drawing roller or a supporting band. From this point a low-tensioned product transportation to the treatment phase II is performed. In this stage the other product side is subjected to the fixing treatment.

The method in accordance with the present invention is performed in the following manner.

The textile product 6 is guided through the moistening device 7 and therefore intensely moistened. Then the textile product 6 is placed against the heated cylinder 1 and pressed by an impermeable pressing band 3 which is guided by the heated deviating roller 5. During the action time $t_I$ in the treatment stage I, the moisture contained in the core of the textile product 6 is brought to the vapor pressure, and the vapor pressure phase corresponding to the applied pressure is performed in the textile product 6. After the end of the pressure action the thusly formed vapor discharges into the atmosphere. The water content of the vapor in this region is detected by a sensor 11. In the event of deviation of the moisture content of vapor from the nominal value of the sensor 11, the moistening devcie 7 is correspondingly regulated.

The compensating devices 10 and 12 serve for a low tension running of the product 6 and also for synchronization between both treatment stages 1 and 2. The moistening device 8 is arranged between the compensating devices 10 and 12.

Due to the mirror-symmetrical arrangement the textile product 6 comes to abutment with its opposite side against the heated cylinder 2 and is pressed by the pressing band 3 in the same way as in the treatment stage 1. Because of the smaller diameter of the cylinder 2 a lower acting time $t_{II}$ is provided. After the end of the pressing action the produced vapor discharges into atmosphere. The water content of the vapor in this region is detected by a sensor 13. If the actual value of the water content deviates from the nominal value of the sensor 13 the moistening device 8 is correspondingly regulated.

In accordance with an important feature of the inventive method the moisture of the textile product 6 is regulated so that shortly after the end of the treatment stage II it has normal moisture or hygroscopic normal moisture. The sensor 13 obtains as a nominal value the hygroscopic normal moisture in correspondence with the product 6 to be treated.

The textile product leaving the treatment stage II can be supplied to a suction station which is identified with reference numeral 9 in FIG. 1.

Figure 2:
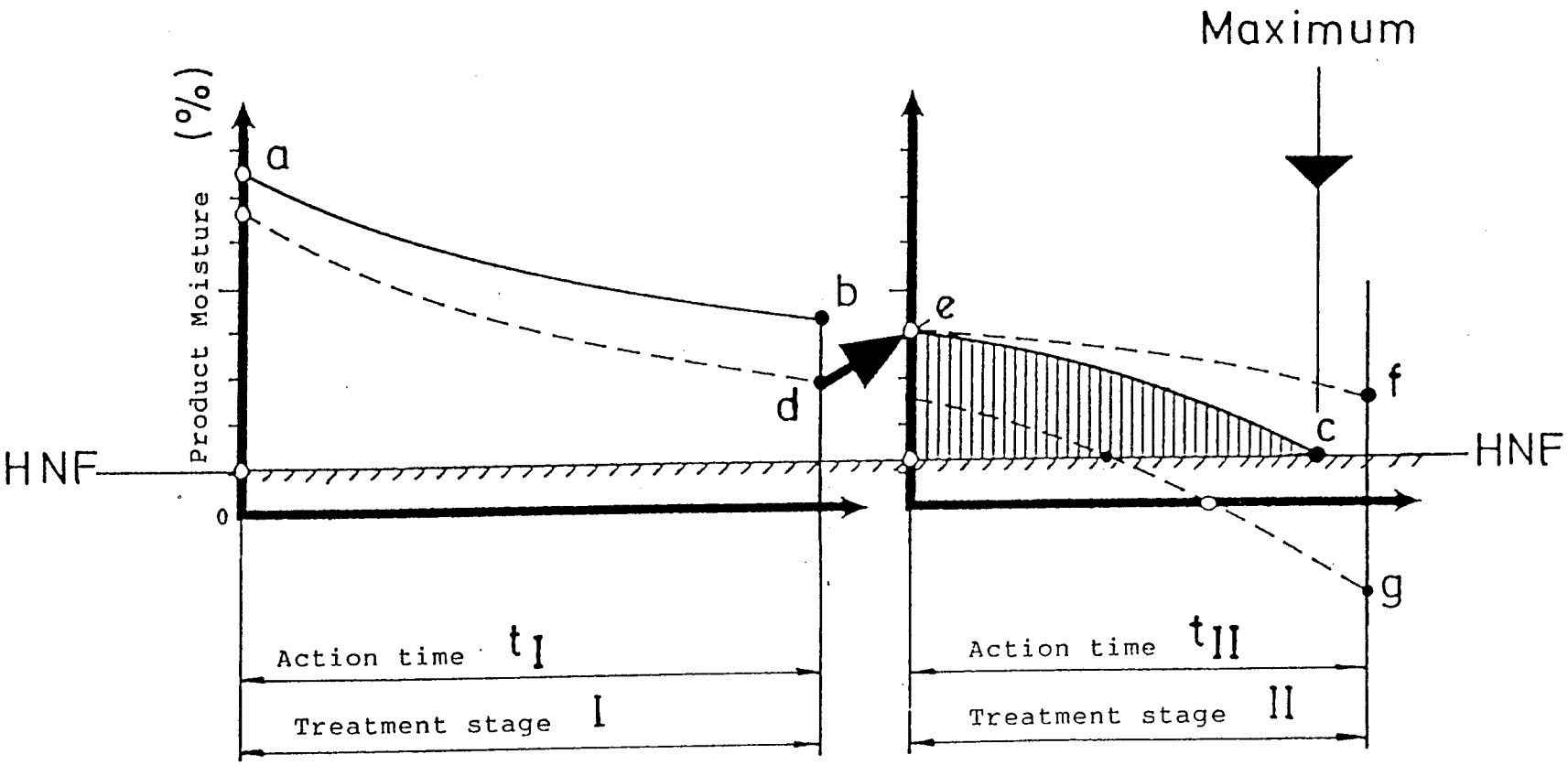
FIG. 2 is a graphic representation of a relation between the time of pressing action and the product moisture in the treatment stages I and II of the inventive method.

In FIG. 2 the treatment stages I and II are shown graphically. The drawing shows the course of the action time $t_I$ and $t_{II}$ in dependence on the course of the moisture of the product during the process. The basis of the hygroscopic normal moisture (HNF) is shown. In the treatment stage I the moisture of the product 6 is reduced from point a to point b. Shortly before the end of the treatment stage II the moisture of the textile product 6 is brought to HNF in point c. When for example in correspondence with the course of the curve shown in a broken line in FIG. 2 the moisture of the textile product is too low in point d, a post-moistening must be performed in the moistening device 8 so as to reach the point e.

If the point c is not reached and the textile product 6 after the end of the treatment stage II remains too moist as shown in the point f, the permanence of the product 6 is affected, since the effect formation is not completed. If to the contrary the product 6 after the end of the treatment stage II is too dry, as shown in point g, then as a result the temperature of the cylinder 2 is increased and a greasy, unnatural gloss and feel is produced. The permanence in this point is not optimal, since during a later smoothing process during the packaging the unnatural gloss and the feel again disappear to a great extent. This is exactly what must be avoided in many cases.

The control of the moisture of the product 6 during decating is performed in accordance with the present invention consecutively in a closed control circuit of the moist phase and dry phase.

The ratio of the time $t_I$ of the pressing action on the textile product 6 in the treatment stage I to the time $t_{II}$ of the pressing action in the treatment stage 2 is at least 1.2–2.5 while the value of the pressure in both stages is the same.

It will be understood that each of the elements described above, or two or more together, may also find a useful application in other types of methods differing from the types described above.

While the invention has been illustrated and described as embodied in a method of continuously permanently decating and fixing of web-shaped textile products, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A method of continuous permanent decating and fixing of web-shaped textile products, comprising the steps of moistening a textile product; treating the moistened textile product in a first moist treatment stage by guiding the moistened textile product over a rotatable and heatable cylinder and pressing against a part of a cylinder surface; subsequently moistening the textile product; then treating the textile product in a second dry stage by guiding the textile product over a rotatable and heatable cylinder and pressing it against a part of a cylinder surface so that in said first moist stage one side of the textile product is in contact with the cylinder surface of said first mentioned cylinder while in the second dry stage the other side of the textile product is in contact with the cylinder surface of the second mentioned cylinder; regulating a moisture of the textile product so that shortly before an end of said second dry treatment stage it has a normal moisture; and maintaining pressing actions in said treatment stages so that a ratio of a time of the pressing action of the textile product in said first moist stage to a time of the pressing action in said second dry stage with identical pressures is at least 1.2–2.5.

2. A method as defined in claim 1, wherein each of said pressings is performed by an impermeable pressing band wrapped around a deviating roller.

3. A method as defined in claim 1, wherein, said regulating of the moisture of the textile product includes controlling of at least one of said moistening steps.

4. A method as defined in claim 1, wherein said regulating of the moisture of the textile product includes controlling of both of said moistening steps.

5. A method as defined in claim 1, wherein said regulating includes sensing a deviation of an actual moisture of the textile product in at least one of said treatment stages from a nominal value and controlling a respective one of said moistening steps in dependence on said deviation.

6. A method as defined in claim 1, wherein said regulating includes sensing a deviation of an actual moisture of the textile product in both of said treatment stages from a nominal value and controlling a respective one of said moistening steps in dependence on said deviation.

* * * * *